US009228708B2

(12) United States Patent
Dings et al.

(10) Patent No.: US 9,228,708 B2
(45) Date of Patent: Jan. 5, 2016

(54) LINEAR LED SYSTEM

(71) Applicant: Luminaid B.V., Roosendaal (NL)

(72) Inventors: Franciscus Cornelius Dings, Roosendaal (NL); Christianus Wilhelmus Johannes Boomaars, Roosendaal (NL)

(73) Assignee: Luminaid B.V., Roosendaal (NL)

( * ) Notice: Subject to any disclaimer, the term of this patent is extended or adjusted under 35 U.S.C. 154(b) by 49 days.

(21) Appl. No.: 13/962,544

(22) Filed: Aug. 8, 2013

(65) Prior Publication Data

US 2014/0043802 A1 Feb. 13, 2014

(30) Foreign Application Priority Data

Aug. 10, 2012 (NL) ..... 2009314

(51) Int. Cl.

| | |
|---|---|
| ***F21S 4/00*** | (2006.01) |
| ***F21S 2/00*** | (2006.01) |
| ***F21V 15/01*** | (2006.01) |
| ***F21V 21/005*** | (2006.01) |
| ***F21V 23/04*** | (2006.01) |

(52) U.S. Cl.

CPC ..... *F21S 4/008* (2013.01); *F21S 2/005* (2013.01); *F21V 15/013* (2013.01); *F21V 21/005* (2013.01); *F21V 23/0471* (2013.01); *F21V 23/0478* (2013.01)

(58) Field of Classification Search

CPC ..... F21S 4/003; F21S 4/008; F21S 2/005; F21V 21/005; F21V 23/0478; F21V 23/0471; F21V 15/013

USPC ..... 362/221

See application file for complete search history.

(56) References Cited

U.S. PATENT DOCUMENTS

| | | | | |
|---|---|---|---|---|
| 7,572,027 | B2 * | 8/2009 | Zampini et al. | 362/225 |
| 7,815,338 | B2 * | 10/2010 | Siemiet et al. | 362/218 |
| 8,308,320 | B2 * | 11/2012 | Tickner et al. | 362/249.06 |
| 8,454,193 | B2 * | 6/2013 | Simon et al. | 362/217.17 |
| 8,764,220 | B2 * | 7/2014 | Chan et al. | 362/217.02 |

(Continued)

FOREIGN PATENT DOCUMENTS

DE 102010063735 A1 6/2012

OTHER PUBLICATIONS

Dutch Search Report and Written Opinion in Application No. NL2009314 dated Jan. 7, 2013.

*Primary Examiner* — Anh Mai
*Assistant Examiner* — Matthew J Peerce
(74) *Attorney, Agent, or Firm* — Leydig, Voit & Mayer, Ltd.

(57) ABSTRACT

A linear LED system including a plurality of line light modules, each line light module comprising an extruded light module housing profile that extends along an axis and that has a profile wall defining an inner profile contour and an outer profile contour and of which a cross sectional view along a plane that is perpendicular to the axis is closed, wherein the profile wall in the cross sectional view defines a LED chamber. At least one LED-strip including a plurality of LEDs is accommodated in an associated LED chamber. The system further includes a plurality of interface modules, each interface module that connect the housing profiles and that an inner space in which at least one power supply module is accommodated so that the power supply module and any other electronic controller equipment is not, or at least to a lesser extend exposed to heat dissipated by the LEDs.

19 Claims, 9 Drawing Sheets

(56) References Cited

U.S. PATENT DOCUMENTS

| | | | | |
|---|---|---|---|---|
| 2005/0090124 | A1* | 4/2005 | Mohacsi et al. | 439/35 |
| 2005/0122064 | A1* | 6/2005 | Chevalier et al. | 315/291 |
| 2007/0058377 | A1 | 3/2007 | Zampini et al. | |
| 2008/0298058 | A1* | 12/2008 | Kan et al. | 362/240 |
| 2011/0090681 | A1* | 4/2011 | Hobson et al. | 362/217.05 |
| 2012/0001554 | A1 | 1/2012 | Leadford et al. | |
| 2012/0063138 | A1* | 3/2012 | Leadford et al. | 362/249.02 |
| 2012/0146512 | A1* | 6/2012 | Kim | 315/113 |
| 2012/0218746 | A1* | 8/2012 | Winton | 362/219 |
| 2014/0140074 | A1* | 5/2014 | Chen et al. | 362/373 |
| 2014/0226328 | A1* | 8/2014 | Schwarz | 362/235 |

* cited by examiner

LINEAR LED SYSTEM

FIELD

The invention relates to a linear LED system.

BACKGROUND

A linear LED system is known from practice and from US2007/0058377 A1. Such a known linear LED system includes:

a plurality of line light modules each line light module comprising an extruded light module housing profile that extends along an axis and that has a profile wall defining an inner profile contour and an outer profile contour and of which a cross sectional view along a plane that is perpendicular to the axis is closed, wherein the profile wall in the cross sectional view defines a LED chamber;

two mounting slots that are adjacent opposite sides of the LED chamber and that are configured to mount one of a diffuser, a lens and a transparent protection shield;

at least one LED-strip including a plurality of LEDs, the at least one LED-strip being accommodated in an associated LED chamber; and at least one power supply module for powering an associated part of the plurality of LEDs and being configured to transform the power that is supplied to a voltage that is fit for powering the associated part of the plurality of LEDs.

US2012/0001554 A1 discloses that the LEDs generate heat that can be detrimental to their performance and operational life (see [0103]). In order to solve that problem, US2012/0001554 proposes to use a heat sink with a plurality of heat sink fins. The heat sink fins may be positioned along the length of the rail body. The problem of overheating of the power supply module is not mentioned nor recognized in US2012/0001554.

SUMMARY

Known linear LED systems accommodate the LED-strip and the power supply module within the same extruded profile.

As a consequence, the power supply module is exposed to the heat that is produced by the LEDs and vice versa. This may cause overheating of power supply module. Long term durability tests have shown that the life time of the power supply module is negatively impacted by the heat produced by the LEDs.

Another disadvantage of the known linear LED systems is that they serve just a single purpose. Connectivity with power supply requires an electrician. Interfacing with other systems such as ethernet, surveillance, wifi is not possible.

In fact, the functionality of the known linear LED systems is limited to lighting.

The present invention aims to at least partly alleviate some of the drawbacks of the known systems.

In other words, the invention is directed to provide a linear LED system that is more durable, provides multi-functionality and is easy to mount and to connect to.

To that end, the invention provides a linear LED system including:

a plurality of line light modules each line light module comprising an light module housing profile of extruded aluminium that extends along an axis and that has a profile wall defining an inner profile contour and an outer profile contour and of which a cross sectional view along a plane that is perpendicular to the axis is closed, wherein the profile wall in the cross sectional view defines a LED chamber;

two mounting slots that are adjacent opposite sides of the LED chamber and that are configured to mount one of a diffuser, a lens and a transparent protection shield;

at least one LED-strip including a plurality of LEDs, the at least one LED-strip being accommodated in an associated LED chamber; and at least one power supply module for powering an associated part of the plurality of LEDs and being configured to transform the power that is supplied to a voltage that is fit for powering the associated part of the plurality of LEDs;

characterized by a plurality of interface modules, each interface module having an interface module housing wall with two end sections and an intermediate section, the end sections having an outer circumference of which the shape and dimensions substantially correspond with the inner profile contour of the profile wall, at least a part of the intermediate section adjacent the end sections having an outer circumference of which the shape and dimensions substantially correspond with the outer profile contour of the profile wall, the interface module housing defining an inner space; and in that the at least one power supply module is accommodated in the inner space of an associated one of the plurality of interface modules.

The interface module that accommodates the power supply module provides inner space that is located at a distance from the heat dissipating LEDs. Thus, the power supply module is less subjected to heat. Consequently, the durability of the linear LED system is improved. Additionally, the interface module provides the possibility to easily connect power lines and communication lines. The extruded light module housing profile preferably is manufactured from aluminium. Such a metal housing functions as a heat sink and thus absorbs the heat of the LEDs as well which is beneficial for the lifetime of LEDs.

Embodiments of the invention will be described with reference to the drawings that show some an example of a linear LED system in which embodiments of the invention are shown.

DETAILED DESCRIPTION

Figure 1:
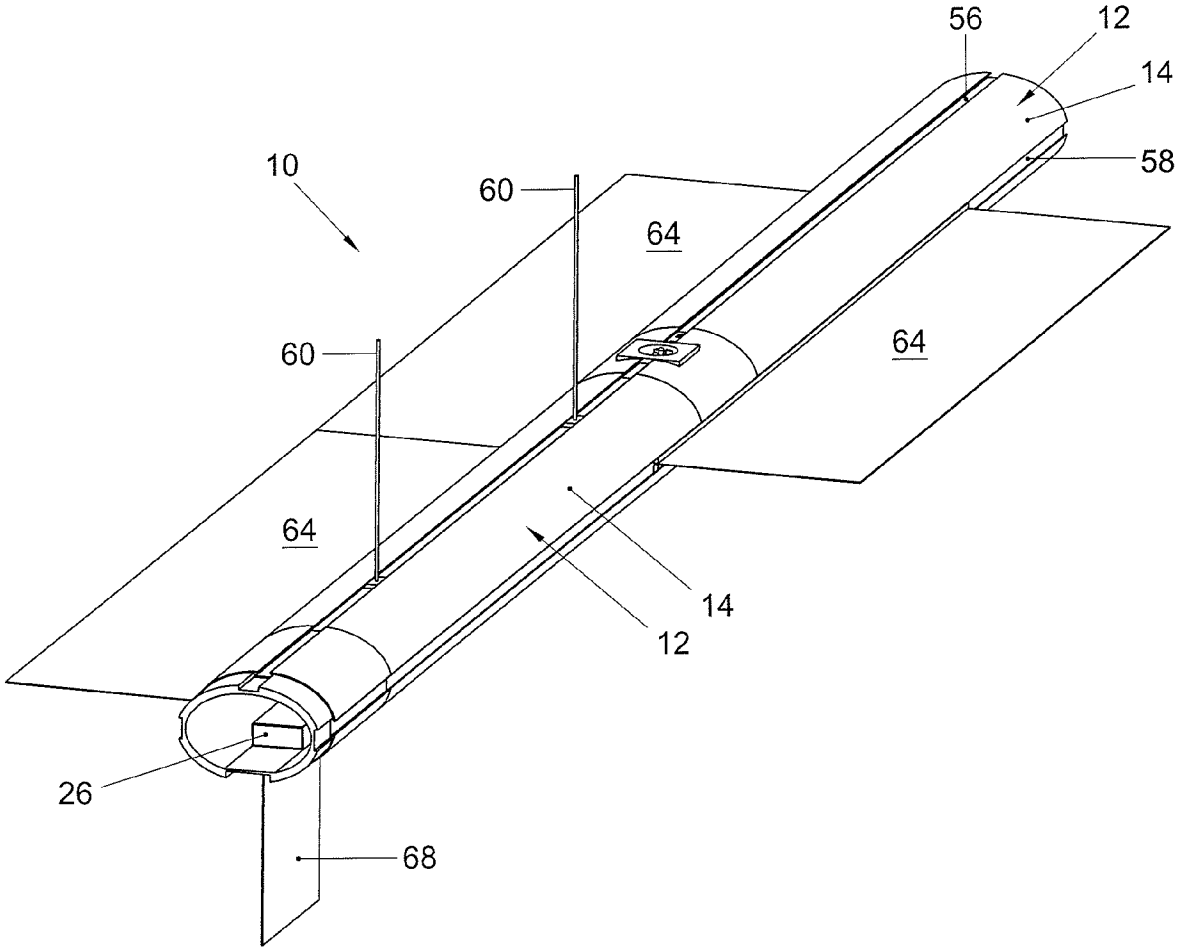
FIG. 1 shows partly a perspective view of an example of a linear LED system from above.

The example of the linear LED system that is shown in the drawing includes various embodiments of the invention. Each embodiment that will be described herein, can be applied separately from the other embodiments. The fact that the example shown in the drawings includes many of the described embodiments does imply that all embodiments of the invention have to be applied or combined.

Figure 7:
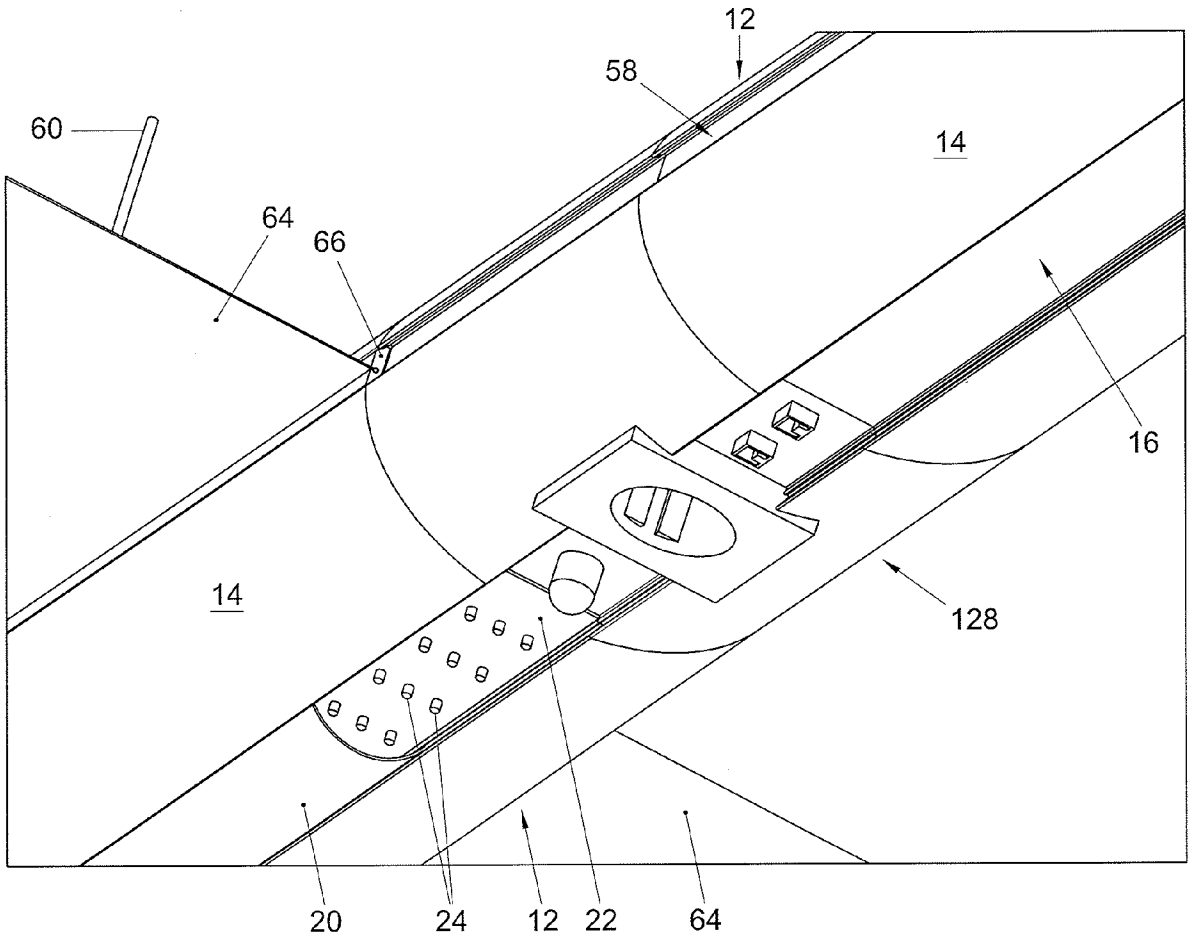
FIG. 7 shows a part of the linear LED system of FIG. 1 in a more detailed perspective view from below.
Figure 8:
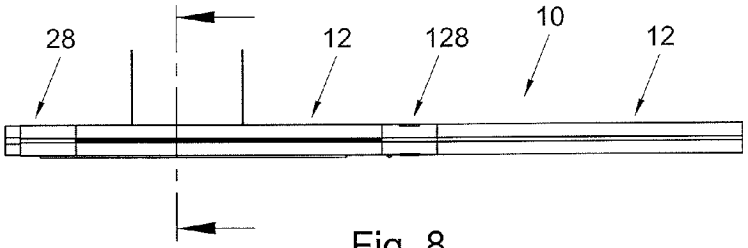
FIG. 8 shows a side view of the example of the linear LED system of FIG. 1.
Figure 9:
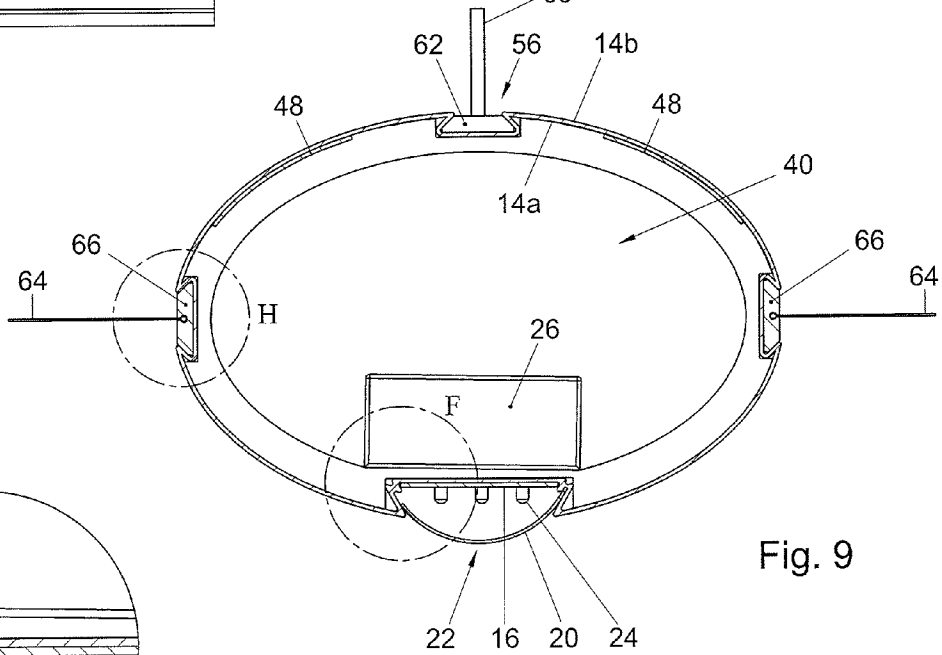
FIG. 9 shows a cross sectional view over line IX-IX of FIG. 8.
Figure 10:
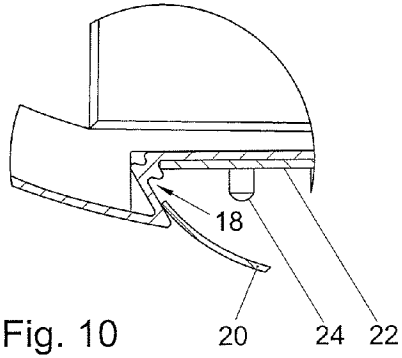
FIG. 10 shows detail X from FIG. 9.
Figure 11:
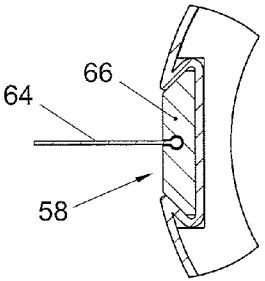
FIG. 11 shows detail XI from FIG. 9.
Figure 13:
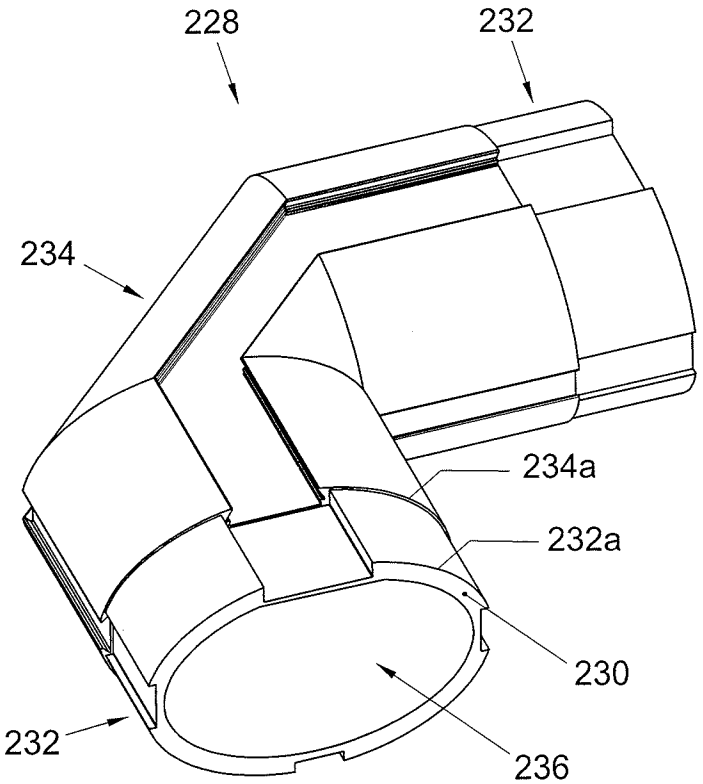
FIG. 13 shows an example of a third embodiment of an interface module that is angular.

Generally, the linear LED system 10 includes a plurality of line light modules 12. Each line light module comprises an extruded light module housing profile 14 that extends along an axis and that has a profile wall defining an inner profile contour 14*a* and an outer profile contour 14*b* and of which a cross sectional view along a plane that is perpendicular to the axis is closed. Preferably, but not necessarily, the extruded housing profile 14 is manufactured from aluminium. A cross sectional view of the profile wall defines a LED chamber 16 and two mounting slots 18 that are adjacent opposite sides of the LED chamber 16 and that are configured to mount one of a diffuser, a lens and a transparent protection shield 20 (see FIGS. 7 and 9). The liner LED system 10 also includes at least one LED-strip 22 including a plurality of LEDs 24. The at least one LED-strip 22 is accommodated in an associated LED chamber 16. The LED system further comprises at least one power supply module 26 for powering an associated part of the plurality of LEDs 24 and being configured to transform the power that is supplied to a voltage that is fit for powering the associated part of the plurality of LEDs 24. The light module housing profile also encloses an inner space 40. An advantage of a metal housing profile 14, for example an extruded aluminium housing profile 14, is that it functions as a heat sink. Thus the temperature of the LEDs will stay low which has an advantageous effect on their lifetime.

The linear LED system additionally comprises a plurality of interface modules 28, 128, 228. Examples of embodiments of interface modules 28, 128, 228 are shown in FIGS. 4, 5, 6 and 13.

Each interface module 28, 128, 228 has an interface module housing wall 30, 130, 230 with two end sections 32, 132, 232 and an intermediate section 34, 134, 234. The end sections 32, 132, 232 have an outer circumference 32*a*, 132*a*, 232*a* of which the shape and dimensions substantially correspond with the inner profile contour 14*a* of the profile wall 14. At least a part of the intermediate section 34, 134, 234 adjacent the end sections 32, 132, 232 have an outer circumference 32*a*, 132*a*, 232*a* of which the shape and dimensions substantially correspond with the outer profile contour 14*b* of the profile wall 14*b*. The interface module housing 30, 130, 230 defines an inner space 36, 136, 236. The at least one power supply module 26 is accommodated in the inner space 36, 136, 236 of an associated one of the plurality of interface modules 28, 128, 228.

By virtue of the fact that the power supply module 26 is accommodated in the inner space 36, 136, 236 of an interface module 28, 128, 228 it is not directly exposed to heat dissipated by the LEDs 24. Consequently, the life time of the power supply module 26 is improved.

In an embodiment, the system may includes an electronic controller that is included in at least one of the plurality of interface modules 28, 128, 228. The electronic controller may configured to control the plurality of LEDs of the individual line light modules of the plurality of line light modules. This controlling may be done per line light module 12 over the entire system. Additionally or alternatively the controlling may also involve controlling individual LEDs within one line light module 12.

This embodiment provides the possibility to switch on and off selected parts of the linear LED system 10. This may be advantageous in parking houses or in factories. The selective switching on and off of individual line light modules 12 may be used to direct a person through a parking house or similar facility. The light modules may have several LED-strips 22 of which the various LEDs 24 are coloured differently. Thus, the controller may control a line light module 12 to emit red light or green light or, for that matter, any desired colour of light. Even light mixtures are feasible. This may be advantageous to, for example, indicate empty and full parking spaces in a parking facility.

In an embodiment, at least one of the plurality of interface modules 12 may include a sensor 138 for sensing the presence or absence of an object in the neighbourhood of the sensor 138. Such an object may be a person or a car or the like. The information obtained with the at least one sensor 138 may be used as input for the electronic controller for controlling the individual line light modules 12.

In an embodiment, the sensor 138 may be a CCD camera sensor. Such a CCD camera sensor 138 may not only be used to sense the presence or absence of a person or an object, but may also be used as security camera. Thus, the linear LED system not only has the function of lighting an area but also of surveiling an area. Especially, in a parking facility this is a big advantage.

In an embodiment, the electronic controller of the linear LED system may includes an image recognition module to sense the absence or presence of an object in the range of the CCD camera sensor 138.

In order to store the video footage that has been taken by the CCD camera sensor 138, an embodiment of the linear LED system may be characterized in that at least some of the plurality of interface modules 28, 128, 228 includes CCD camera sensor 138 as well as a video storage module for storing video information.

In an embodiment, the camera may be a panoramic camera with movement detection and zoom options. Such a camera may monitor the entire environment of the camera and start filming when, for example, a group of more than 10 people are standing close to one another. Such a group may be signal of disorderly behaviour that should be closely monitored.

In an embodiment, at least one of the plurality of interface modules 28, 128, 228 may include a smoke sensor. The smoke sensor may be connected to the electronic controller and may form an integral part of a surveillance module that is included in the linear LED system 10.

Figure 12:
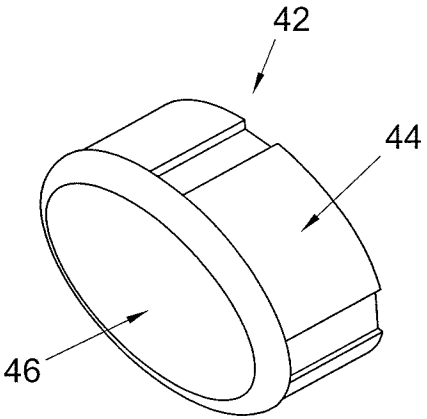
FIG. 12 shows an example of an embodiment of an end cap of the system.

The end of a light module 12 that is not connected with an interface module 28, 128, 228 may, in an embodiment, be closed off by an end cap 42 as shown in FIG. 12. The end cap 42 also has an end section 44 that it similar to the end sections of the interface modules 28, 128, 228 and that can be inserted into the housing 14 of the light module 12. Additionally, the end cap 42 has a closes end wall 46 to close off the inner space 40 of the housing 14.

In order to protect the inner space 36, 136, 236 of the interface modules 28, 128, 228 and inner space 40 of the light modules housing 14 against moisture, it is, in accordance with an embodiment of the invention, advantageous when the connection between a said light module housing 14 and a said interface module 28, 128, 228 is in conformity with IP-65 according to international standard IEC 60529.

In an embodiment, the linear LED system may include a contact loudspeaker 48 (see FIGS. 3 and 9) that is connected to the profile wall of at least one of the plurality of light module housing profiles 14 of the system 10. It is advantageous when this loudspeaker 48 is a contact-loudspeaker 48 that is positioned in the inner space 40 of the light module housing profile 14 so that it may be protected against moisture and other external influences. The housing profile 14 and the inner space 40 thereof may serve as sound box to amplify the sound generated by the loudspeaker 48.

In an embodiment, at least some of the plurality of interface modules 128 may include an Ethernet connection module having an ethernet connection port 50. In the example of the interface module shown in FIG. 5, the interface module 128 has four Ethernet ports 50, two at the top and two at the bottom thereof.

Figure 5:
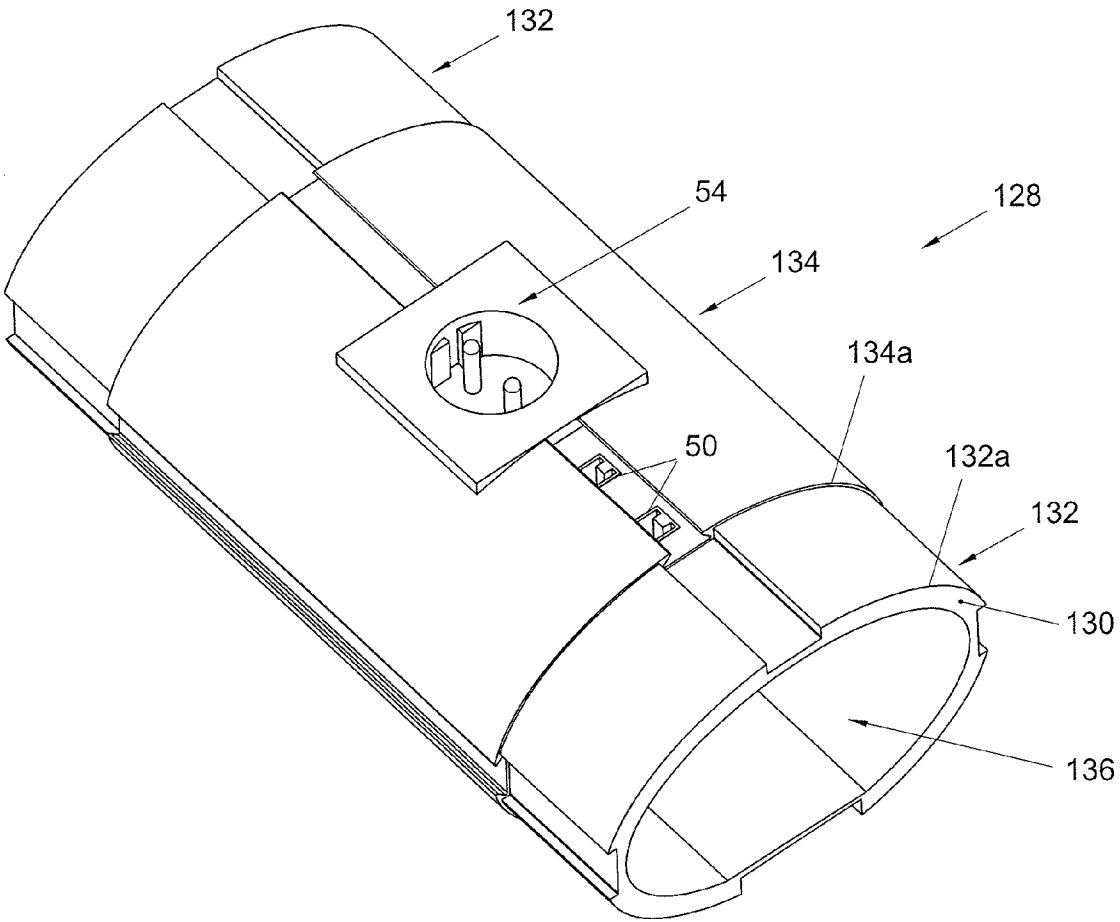
FIG. 5 shows a perspective view from above of an example of a second embodiment of an interface module.
Figure 6:
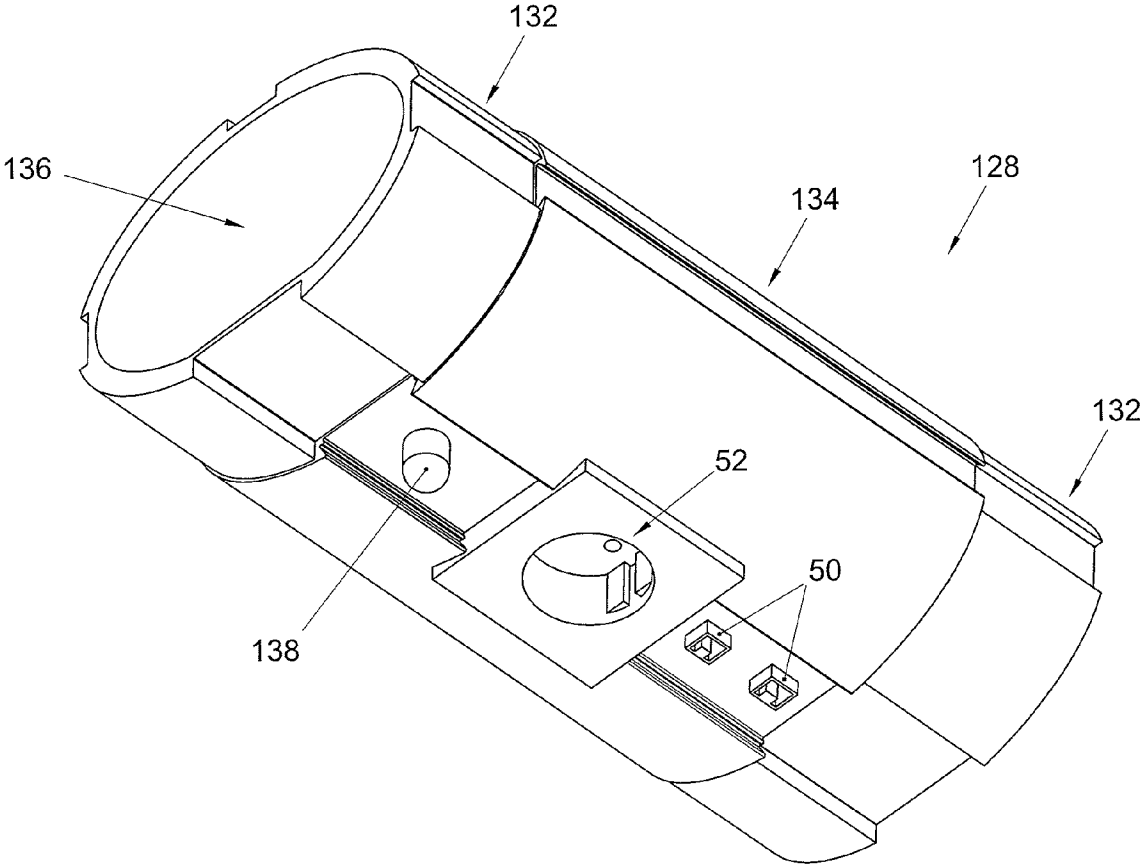
FIG. 6 shows a perspective view from below of the example shown in FIG. 5.

The example the interface module 128 of FIG. 5 also includes a two further embodiments of the invention. Firstly, a power connector 52 of the female type. This power connector 52 can be used to connect external devices to the mains. Secondly, a power connector 54 of the male type. This power connector 54 can be used to supply electricity to the at least one power supply module 26 of the linear LED system 10 and to supply electricity to the other electronic and electric components of the system 10.

In an embodiment, the interface module 28, 128 may be is linear so that two light module housing profiles 14 connected to the end sections 32, 132 of the interface module 28, 128 extend collinear. Examples of such embodiments are shown in FIGS. 1-11. Additionally, the linear LED system 10 may also include interface modules 228 that are angular so that two light module housing profiles 14 connected to the end sections 232 of the interface module 228 include an angle. Thus a mesh of light module housing profiles 14 may be created in a factory or in a parking facility. Also outdoor use of the linear LED system 10 is feasible. Some of the interface modules 28, 128, 228 may be connected to a vertical pole that is connected to the ground surface. It is even possible that the vertical pole be formed by one or more light module housing profiles 14. As such a sort of a cube or rectangular, or for that matter any other 3D-structure may be constructed of which the edges are formed by light module housing profiles 14 and of which the corners are formed by interface modules. To form a cube like structure, the interface modules should have three end sections that extend perpendicularly to each other. Each end section of a corner interface module is then connected to a light module housing profile 14.

In an embodiment, the profile wall of the light module housing profile 14 may includes an upper dovetail slot 56. Additionally, the profile wall of the light module housing 14 may also include two opposite side dovetail slots 58. The upper dovetail slot 56 may be used to connect a suspension assembly to the housing profile 14.

In an embodiment, the suspension assembly may include suspension cables or suspension rods 60 and mounting blocks 62 that are slidingly receiveable in a said upper dovetail slots 56 and that are connected to a lower end of an associated suspension cable or suspension rod 60.

In an embodiment, the linear LED system 10 may include ceiling elements 64 and ceiling element connectors 66 that are slidingly receiveable in said side dovetail slots 58 and that are connected to an external edge of an associated ceiling element 64. The figures show the ceiling elements 64 only partly. However, the ceiling elements 64 may extend between neighbouring housing profiles 14 and thus form a ceiling.

In an embodiment, the ceiling elements 64 include flexible foil or cloth material or rigid material.

Figure 2:
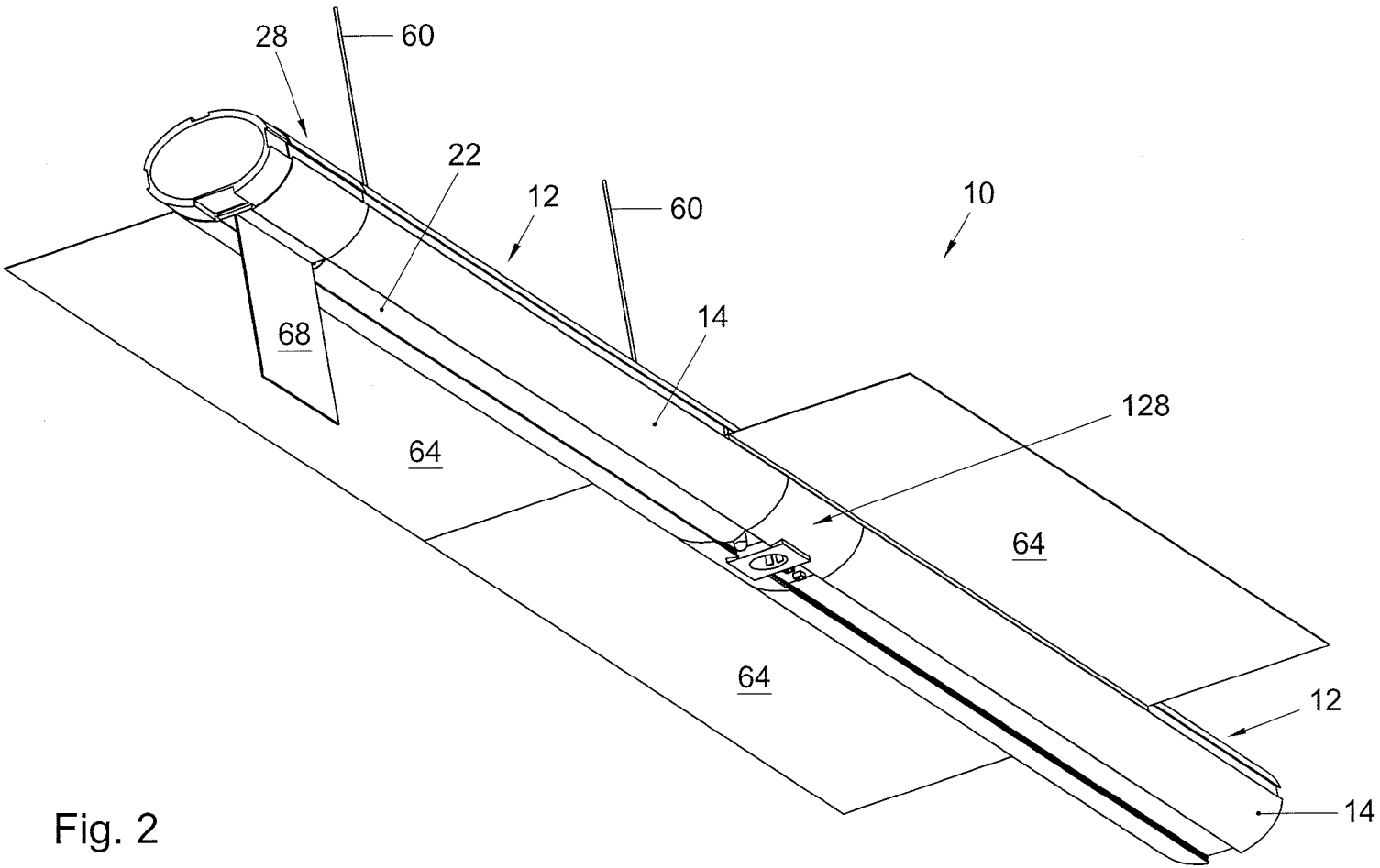
FIG. 2 shows partly a perspective view of the example of FIG. 1 from below.
Figure 3:
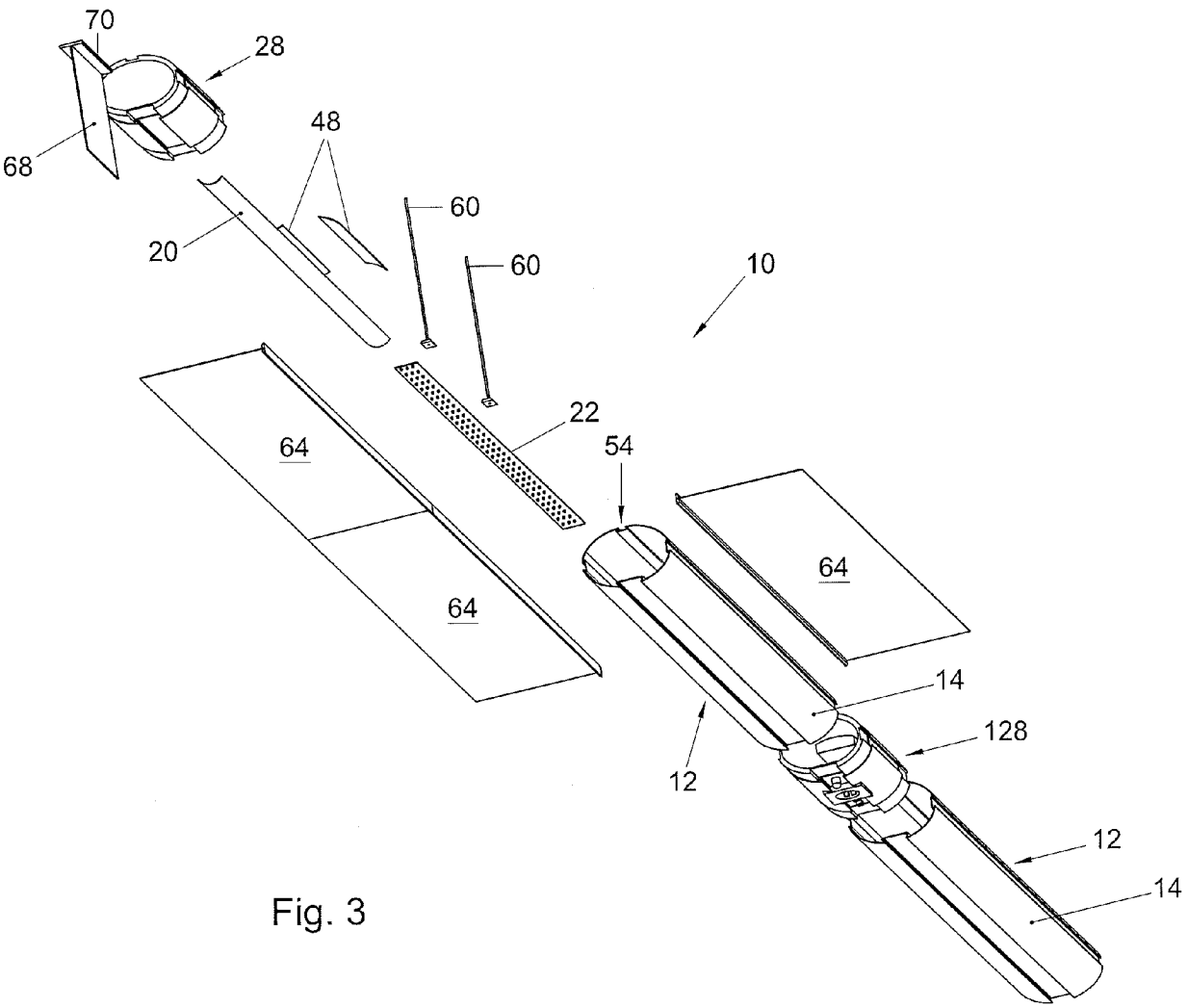
FIG. 3 shows an exploded view of the example of FIGS. 1 and 2.
Figure 4:
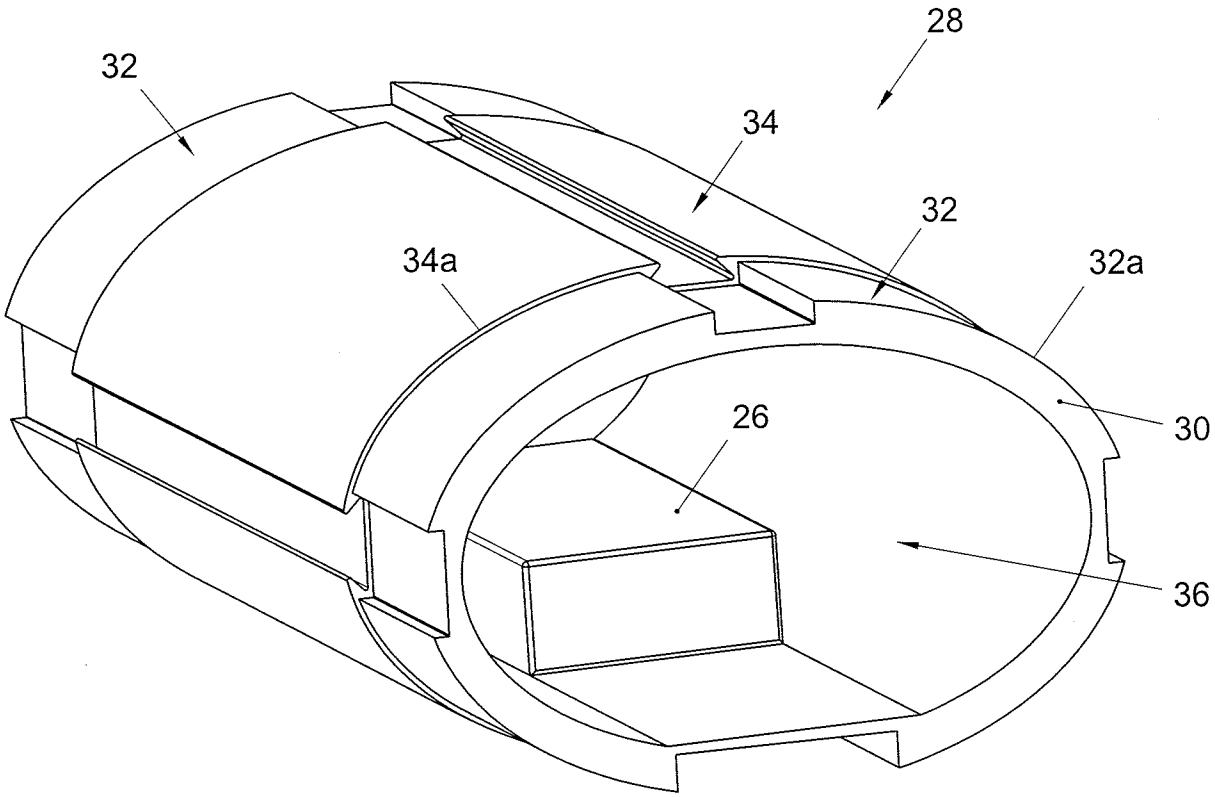
FIG. 4 shows a perspective view an example of a first embodiment of an interface module.

In an embodiment, the linear LED system 10 may includes an emergency sign 68 or emergency light that may be connected to an interface module 28, 128, 228 or a housing profile in the mounting slots 18 of the LED chamber 16 or in the extension of these slots in the interface modules as shown in FIGS. 1-3. To that end, the emergency sign 68 may also include a connector 70 (see FIG. 3) of the same type as mounting blocks 62. The connector 70 should be dimensioned such that it is configured for engagement of the mounting slots 18 of the LED chamber 16. Alternatively, when the sign 68 is mounted in the upper dovetail slot 56, the configuration of the connector 70 will be similar to the configuration of the mounting blocks 62.

Generally, the light modules 12 include at least one of a diffuser, a lens and a transparent protection shield 20 that is connected with the associated light module 12. It should be noted that the light modules 12 may also include in series, a lens and a diffuser or a lens and a transparent protection shield 20. By changing the type of lens, the application of the lighting system may be changed. The same lighting system may with a lens of a first type be fit to be used at a height of e.g. 2.8 m, whereas the same lighting system with a lens of a second type may be fit to be used at a height of 12 m. Thus, the number of applications of the novel lighting system are numerous, while the number of different parts that constitute the lighting system may be minimized.

In an embodiment, the diffuser 20 that is connected with the associated light module 12 may be of the holographic type. With an holographic diffuser, the LED light may be directed at a specific area. Thus lighter paths may be indicated on the floor which may help persons to find their way.

For an easy mounting of the LED-strip 22, it may be advantageous when the connection of the at least one LED-strip and an associated one of the light module housing profiles 14 is of a magnetic type. To that end, the bottom of the LED chamber 16 may be provided with a magnetic strip and the LED strip 22 may include some ferromagnetic parts that are attracted by the magnetic strip. A small hole in the bottom of the LED chamber may be provided to guide the power cables of the LED strip 22 to the inner space 40 of the housing profile 14 to the power supply module 26.

In an embodiment, the side dovetail slots 58 may accommodate an additional LED strip or, alternatively, a light conductor. The LED strip or light conductor may emit a marking colour, for example red or green, to indicate something, for example, the presence or absence of a free space on a parking area. Preferably, the additional LED strips or light conductors are also controlled by an electronic controller of the system so that the can be switched on and off dependent on various circumstances, for example, data that has been received from a central processing unit or from sensors 138 of the system 10.

It is clear that the inner space 40 of the housing profiles 14 and the inner spaces 36, 136, 236 of the interface modules 28, 128, 228 can be used for guidance of various power and/or data cables. It is also within the scope of the present invention that a plurality of the interface modules 28, 128, 228 of a linear LED system 10 include an electronic controller and that wireless or wired communication between the plurality of controllers takes place to control the entire linear LED system 10. Data communication may also be feasible via power cables that may extend in the liner LED system 10.

With the linear LED system 10 described above, an entire light, power and data communication as well as a surveillance infrastructure and simultaneously a ceiling may be provided. From a point of view of mounting and installation costs the system 10 is extremely favourable relative to the mounting and installation costs of separate systems as now is the normal practice.

Although illustrative embodiments of the present invention have been described above, in part with reference to the accompanying drawings, it is to be understood that the invention is not limited to these embodiments. Variations to the disclosed embodiments can be understood and effected by those skilled in the art in practicing the claimed invention, from a study of the drawings, the disclosure, and the appended claims. Reference throughout this specification to "one embodiment" or "an embodiment" means that a particular feature, structure or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, it is noted that particular features, structures, or characteristics of one or more embodiments may be combined in any suitable manner to form new, not explicitly described embodiments.

The invention claimed is:

1. A linear light emitting diode (LED) system including:

a plurality of line light modules, each line light module comprising a single extruded light module housing profile that:

is substantially tubular, extends along an axis, has a profile wall defining an inner profile contour and an outer profile contour, and has a closed cross sectional view along a plane that is perpendicular to the axis, wherein the profile wall in the cross sectional view defines:

a LED chamber; and two mounting slots that are adjacent opposite sides of the LED chamber and that are configured to mount one of the group consisting of: a diffuser, a lens and a transparent protection shield;

at least one LED-strip including a plurality of LEDs, the at least one LED-strip being accommodated in an associated LED chamber;

at least one power supply module for powering an associated part of the plurality of LEDs and being configured to transform the power that is supplied to a voltage that is fit for powering the associated part of the plurality of LEDs; and a plurality of interface modules, each interface module having an interface module housing wall with two end sections, and an intermediate section, wherein the end sections of the interface modules have outer circumference shape and dimensions substantially corresponding with the inner profile contour of the profile wall, and wherein at least a part of the intermediate section adjacent to one of the end sections has outer circumference shape and dimensions substantially corresponding with the outer profile contour of the profile wall, wherein the interface module housing defines an inner space;

wherein the at least one power supply module is accommodated in the inner space of an associated one of the plurality of interface modules.

2. The linear LED system according to claim 1, wherein the system includes an electronic controller that is included in at least one of the plurality of interface modules, wherein the electronic controller is configured to control the plurality of LEDs of the individual line light modules of the plurality of line light modules on a per line light module basis.

3. The linear LED system according to claim 2, wherein in at least one of the plurality of interface modules includes a sensor for sensing the presence or absence of an object in the neighborhood of the sensor, wherein the information obtained with the at least one sensor is used as input for the electronic controller for controlling the individual line light modules.

4. The linear LED system according to claim 3, wherein the sensor is a CCD camera sensor.

5. The linear LED system according to claim 4, wherein the electronic controller includes an image recognition module to sense the absence or presence of an object in the range of the CCD camera sensor.

6. The linear LED system according to claim 1, further including:

a contact loudspeaker connected to the profile wall of at least one of the plurality of light module housing profiles.

7. The linear LED system according to claim 1, wherein at least one of the plurality of interface modules includes an Ethernet connection module having an Ethernet connection port.

8. The linear LED system according to claim 1, wherein the profile wall of the light module housing profile includes:

an upper dovetail slot extending along the entire length of the light module housing profile; and two opposite side dovetail slots extending along the entire length of the light module housing profile.

9. The linear LED system according to claim 8, wherein the ceiling elements include at least one of the group consisting of: a flexible foil, a cloth material, and a rigid material.

10. The linear LED system according to claim 1, wherein at least one of the plurality of interface modules includes an emergency sign or emergency light.

11. The linear LED system according to claim 1, wherein at least one of the plurality of interface modules includes a smoke sensor.

12. The linear LED system according to claim 1, wherein at least one of the light modules includes at least one attached component taken from the group consisting of: a diffuser, a lens and a transparent protection shield, and wherein the attached component is connected with the associated light module.

13. The linear LED system according to claim 1, wherein at least one of the light modules includes a diffuser that is connected with the associated light module, and wherein the diffuser is a holographic type diffuser.

14. The linear LED system according to claim 1, wherein at least one of the plurality of interface modules includes a power connector of the female type.

15. The linear LED system according to claim 1, wherein at least one of the plurality of interface modules includes a power connector of the male type.

16. The linear LED system according to any one of claim 1, wherein a connection of the at least one LED-strip and an associated one of the light module housing profile is of a magnetic type connection.

17. The linear LED system according to claim 8 further including:

an additional LED strip or a light conductor, wherein the additional LED strip or the light conductor is mounted in a side dovetail slot of at least one of the light module housing profiles.

18. The linear LED system according to claim 5 further including a video storage module for storing video information.

19. The linear LED system of claim 8 wherein the profile wall of the light module housing profile includes further includes:

ceiling elements for forming a ceiling; and ceiling element connectors that are:

slidingly receivable in said side dovetail slots, and connected to an external edge of an associated ceiling element.

* * * * *